United States Patent [19]

Anhalt

[11] 4,046,445

[45] Sept. 6, 1977

[54] SPRING BUSHING FOR CONDUCTIVE BACK-PLANE CONNECTION

[75] Inventor: John W. Anhalt, Orange, Calif.

[73] Assignee: International Telephone and Telegraph Corporation, New York, N.Y.

[21] Appl. No.: 716,822

[22] Filed: Aug. 23, 1976

[51] Int. Cl.[2] ..... H01R 9/06

[52] U.S. Cl. ..... 339/95 D; 339/17 C; 339/220 R

[58] Field of Search ..... 339/17 C, 17 CF, 95 D, 339/220 R, 220 T, 275 B

[56] References Cited

U.S. PATENT DOCUMENTS

| | | | |
|---|---|---|---|
| 3,038,105 | 6/1962 | Brownfield | 339/17 C |
| 3,156,517 | 11/1964 | Maximoff et al. | 339/95 D |
| 3,504,328 | 3/1970 | Olsson | 339/17 C |
| 3,634,879 | 1/1972 | Longenecker et al. | 339/17 CF |
| 3,704,441 | 1/1974 | Douglass | 339/220 T |
| 3,778,755 | 12/1973 | Marks | 339/220 R |
| 3,784,965 | 1/1974 | Murphy | 339/17 C |

*Primary Examiner*—Gerald A. Dost
*Attorney, Agent, or Firm*—Thomas L. Peterson

[57] ABSTRACT

A generally cylindrical spring bushing formed of resilient, conductive sheet metal folded to form a generally cylindrical exterior with a coaxially re-entrant section within the shell forming said exterior for gripping a coaxially emplaced pin, such as a typical square tail employed as a wire-wrap terminal. The bushing, because of its re-entrant coaxial folded shape, is capable of exerting a relatively large spring force against the hole or bore in a back-plane and also against the wire-wrap pigtail inserted therethrough, within an axial length not exceeding the individual back-plane thickness.

6 Claims, 6 Drawing Figures

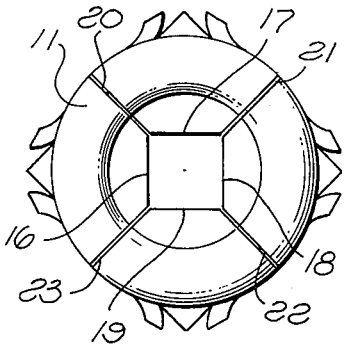
FIG. 1B
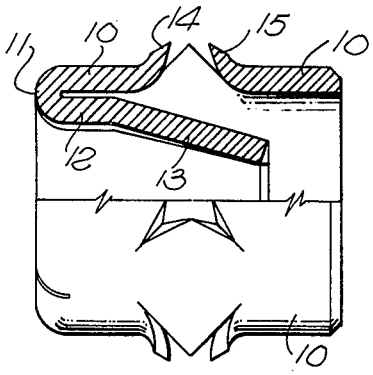
FIG. 1A
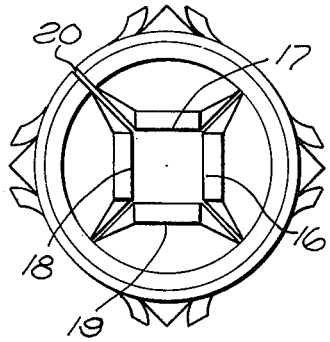
FIG. 1C
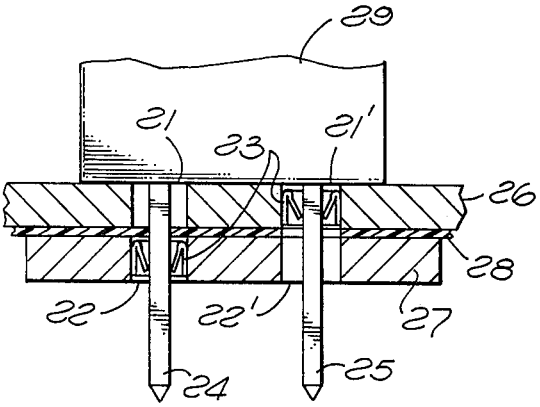
FIG. 2
FIG. 3
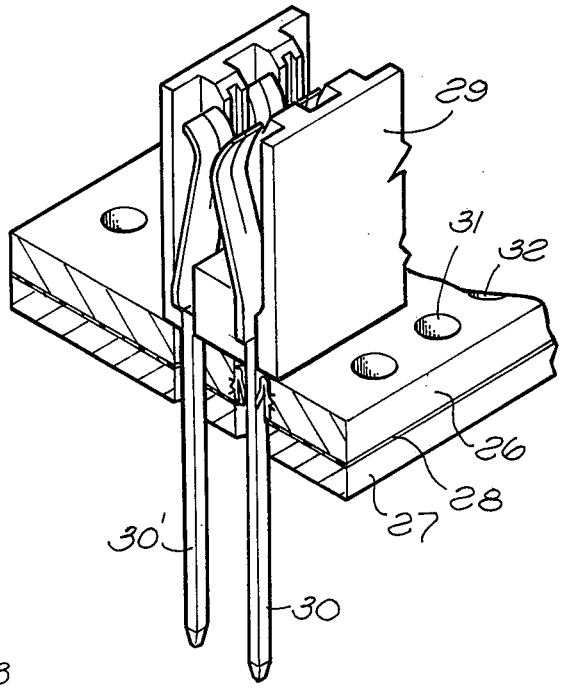
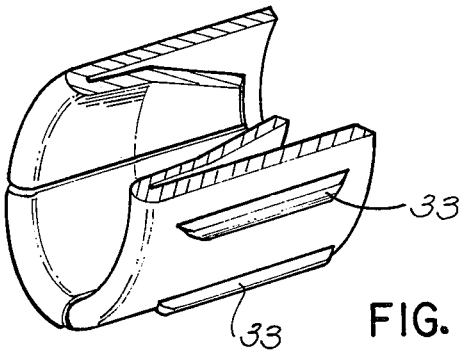
FIG. 4

SPRING BUSHING FOR CONDUCTIVE BACK-PLANE CONNECTION

BACKGROUND OF THE INVENTION

1. Field of the Invention

The Invention relates generally to devices for electrical and mechanical installation of conductive terminal pins or pigtails into and through conductive back-planes, and more specifically, to conductive bushings for providing the electrical and mechanical interconnection of electrical contacts to a selected one of a plurality of superimposed insulated metallic plates.

2. Description of the Prior Art

Modern electronic hardware is produced in highly automated fabrication and assembly operations. Printed circuit boards, separately manufactured, are assembled in connector arrangements in circuit combinations, for digital computers and the like, by suitably interconnecting groups of printed circuit boards. In such arrangements, it is conventional to plug each printed circuit board into a connector mounted on the front face of a metal plate (back-plane) which serves to establish a ground plane for the electrical circuits on the printed circuit boards, as well as providing mechanical support for the assembled printed circuit boards and connectors. In addition to a ground plane, a separate, generally parallel, second conductive plane operates as a power distribution buss or voltage plane. These are separated by a layer of insulating material forming a sandwich of the two conductive planes separated by the said insulating material layer.

The connector assemblies into which the circuit boards are plugged include elongated conductive pins (also variously called pins, tails, pigtails, etc.) which electrically extend contacts of the circuit board connector sockets through the ground and voltage back-planes to project beyond for further connection. This further connection frequently is accomplished by a known technique, generally referred to as wire-wrapping. For that, a square tail is commonly employed.

In the usual prior art arrangement of the type aforementioned, a bushing of one form or another is used to mechanically and electrically secure at least selected ones of said tails within a corresponding opening either in the ground or voltage plane, as appropriate. Prior art bushings used for that purpose have generally been of the machined type, including external knurling or the like, for press-fitting into the corresponding back-plane bore.

A typical prior art arrangement to which the present invention is applicable is shown in U.S. Pat. No. 3,518,610. The so-called insert or bushing of the machine type, is shown in U.S. Pat. Nos. 2,995,617; 3,365,539; 3,760,496; 3,704,441; and in the technical literature in general.

The type of progressive die formation of sheet metal parts applicable to manufacturing of the novel bushing in accordance with the present invention, is shown in U.S. Pat. No. 3,288,915. Wirewrapping, per se, is illustrated in U.S. Pat. Nos. 3,209,311; 3,420,087, and 3,365,539.

Other types of bushings, including sheet metal types are shown in U.S. Pat. Nos. 3,420,087; 2,967,285; and 3,564,479. These other types of bushings rely in general on the characteristics of resilient sheet metal (spring metal) for their griping action within a back-plane bore or hole and also against the pin or tail inserted therethrough.

The aforementioned machined ground bushing has a high spring rate (virtually a press-fit or interference fit). This imposes a close tolerance requirement on the bushing, the plate bore and the terminal post. Tolerance variations may result in a requirement for hand-fitting which greatly increases the cost of production. Moreover, machine bushings are poorly adapted to automated assembly, whereas progressively formed sheet metal parts may be automatically inserted while still joined to a strip of metal from which they were blanked and formed.

The nature of a machined bushing for the present purpose usually requires that it be elongated beyond the thickness of the metallic back-plane into which it is inserted. This is because the resilient members gripping the pin or tail passing therethrough must ordinarily be beyond the relatively monolithic bushing body which is press-fit into the back-plane which it is intended to contact. This has the effect of requiring a larger clearance hole in the back-plane of the sandwiched pair through which it must pass without contact. Accordingly, extra manufacturing processing is required in order to accommodate both sizes of back-plane bores (holes).

The various prior art sheet metal bushings encountered are costly and either poorly adapted to the double plane (sandwich arrangement aforementioned) configuration, poorly adapted to automatic insertion, or leave much to be desired in the quality of the electrical and/or mechanical retention of the pin or tail passing therethrough.

The manner in which the present invention deals with the prior art disadvantages will be evident as this description proceeds.

SUMMARY OF THE INVENTION

It may be said to have been the general objective of the present invention to provide a bushing for installing conductive pins or tails through at least one conductive back-plane in an electronic circuit hookup. The bushing, according to the invention, is readily and inexpensively fabricated and provides good electrical and mechanical bonding of the pins or tails to the back-plane.

The bushing, according to the invention, may be constructed with an axial length substantially no more than the thickness of the back-plane, thereby avoiding the requirement for an oversize clearance hole in a plane from which it is to remain electrically isolated in the aforementioned sandwich arrangement where two or more conductive planes are fitted together with only a layer of insulating material between adjacent conductive planes.

The novel bushing, in accordance with the present invention, is formed by progressive die techniques, starting with a flat sheet of metal which is blanked to a predetermined shape, progressively folded along one edge about a predetermined radius, said fold producing a bend on the order of 180°±, and rolling the folded metal into a generally cylindrical shaped piece, such that the folded portion becomes an internal, re-entrant or incurved section. The progressive forming process may be carried on while the bushing being formed remains as a part of a strip which is discretely advanced from step-to-step of the progessive forming operation during a known type of automated manufacturing process.

A tab or thin section of metal may remain connected to the external cylindrical surface of the finished bushing permitting its automatic insertion into a selected back-plane bore. The external cylindrical surface may contain one or more barbs oriented in a predetermined direction for enhancing the grip of the external cylindrical surface of the bushing within the back-plane bore, as aforementioned.

The bushing according to the invention would normally be fabricated of a relatively high electrical conductivity spring metal material, such as beryllium copper, phosphor bronze, etc., although certain grades of stainless steel or other metals of relatively good conductivity may be employed as long as they possess or can be processed to possess appropriate spring metal characteristics.

The appropriate alloys of copper, such as the aforementioned beryllium copper and phosphor bronze can be cold worked without losing their spring resilience however, there is nothing about the invention which would preclude the forming of the bushing in the progressive die in an annealed condition, a subsequent heat treating step being a part of the manufacturing process (even by automated methods).

The inwardly directed spring resilience of the aforementioned re-entrant portion of the bushing provides a spring force yielding resiliently to grip the pin or wire-wrap terminal tail as it is inserted. A plurality of slots spaced circumferentially and running axially through at least a portion of the re-entrant portion of the bushing, effectively produces a plurality of inwardly directed spring fingers which bear against the pin or tail inserted therethrough. Normally the bushing is installed in the back-plane and the axial slot or slit remaining when the flat-formed piece is formed into a cylindrical shape is forced to close, at least to some extent during insertion in the back-plane, thereby acting to maintain outward pressure against the walls of the back-plane bore into which it is inserted.

The details of a typical embodiment according to the present invention will be described hereinafter.

BRIEF DESCRIPTION OF THE DRAWINGS

FIG. 1A is a partially sectioned lateral view of a bushing in accordance with the present invention.

FIG. 1B is a first end-view of the bushing of FIG. 1A.

FIG. 1C is a second end-view of the bushing of FIG. 1A.

FIG. 2 depicts a typical sandwich arrangement of voltage and ground planes in partially sectioned form, illustrating the application of the bushing in accordance with the present invention.

FIG. 3 illustrates a typical electronic circuit board connector mounting and voltage and ground plane combination, showing the use of the bushing of the present invention therein.

FIG. 4 is a partially sectioned view of an alternative bushing according to the invention similar to FIG. 1A except having external circumferential surfact axially extending louvre-like barbs.

DESCRIPTION OF THE PREFERRED EMBODIMENT

Referring now to FIG. 1A, a typical bushing according to the invention is shown with one quadrant sectioned. The spring metal material of which it is fabricated has a generally exterior cylindrical shell or portion 10 and an interior generally coaxial incurvated (re-entrant) shell or portion 12 and 13.

As already indicated, the bend or elbow 11, which is the transition between the outer generally cylindrical shell (wall) 10 and the coaxial re-entrant shell (portions) 12 and 13, is flat blanked, before the part is formed into the generally cylindrical shape. As also previously indicated, the bend 11 and the additional bend between the portions 12 and 13 are formed in progressive die steps by known means, for example, as described in U.S. Pat. No. 3,288,915, and elsewhere in the technical literature. The barbs 14 and 15 are also preferably formed during this progressive dye process while the part is still in the flat piece form.

The bend at 11 is substantially a 180° bend and the additional bend or flare-out between portions 12 and 13, is at some angle consistent with spring factors and other manufacturing considerations. Normally, with a pin (wire-wrap tail) inserted therethrough, portion 13 (spring fingers) is deflected radially outward so that it exerts a substantial retaining force against the pin.

Referring now to FIGS. 1B and 1C for further clarity of the nature of the part illustrated in FIG. 1A, it will be seen that there are a plurality (four in this case) of radial cuts, running from the FIG. 1B end of the part toward the center of FIG. 1A. These cuts run at least as far as the distance from the outside edge of the bend 11 to the right-hand extreme of portion 13, as viewed in FIG. 1A, except that they need not proceed farther along the outer wall (shell) 10. The purpose of these cuts is to provide four (for example) independent gripping edges 16, 17, 18, and 19, as seen on FIGS. 1B and 1C. The re-entrant member 13 is thus circumferentially divided into a plurality of spring fingers which, as a matter of design, might be relatively little deflected (radially outwardly) when the pin, such as 24 or 25 in FIG. 2, is inserted. It is also possible to have pin and bushing geometry such that insertion of the pin through the bushing of FIG. 1A would deflect the spring fingers 16, 17, 18, and 19, radially outward to the point of increasing the angle between 12 and 13 to substantially 180°.

In FIG. 1C it will be additionally noted that the cut or part in the cylindrical surface (shell) 10, as shown at 20. This is the juxtaposition between the ends of the part in flat form during the progressive dye and manufacturing process, once the part is formed into the general cylindrical shape aforementioned. The width of this slot 20 may be more or less and is a factor in providing outward spring pressure exerted by the bushing against the walls of the bore in the back-plane with which it is associated. For insertion, into the bore, the part may be radially compressed so that the abutment 20 is reduced to substantially zero, the resilience of the metal thereafter opening 20 until the outer cylindrical walls 10 are firmly in contact with the inside wall of the bore into which it is inserted. The cut 20 coincides with one of the four spring finger producing cuts as illustrated, however, this is not necessarily the case. In FIG. 2, a typical "sandwich" structure is shown, comprising two conductive back-planes 26 and 27, separated by a layer of insulating material 28. These back-planes 26 and 27 would typically be voltage and ground planes in either order. The conductive back-plane 26 includes two bores or holes, 21 and 21' congruent with two bores of the same size 22 and 22' in 27, the latter being similarly congruent with the bores of 26.

In the typical printed circuit board connector arrangement, a connector body 29, more fully shown in FIG. 3 is mounted on the back-plane sandwich and the pins 24 and 25 (also 30 and 30′ from FIG. 3) are an integral part of such a connector body 29. Normally, the insulation layer 28 would also have congruent openings matching the aligned bores in the back-planes such as bores 21 and 22. It will be realized however, that (alternatively) pins 24 or 25 would pass through a smaller hole in the insulation layer 28, or that a larger hole in 28 would still serve the purpose of insulating back-planes 26 and 27 from each other. In the typical circuit arrangement in which a number of printed circuit boards containing solid state electronic components, perhaps of both integrated circuit and discrete component types, the supply voltage carried by a voltage plane is relatively low, and accordingly, insulation requirements are not severe.

FIG. 3 additionally depicts other back-plane holes or bores 31 and 32, since it is to be understood that such an arrangement would include a number of duplications of the connector body 29. The pins 30 and 30′ are shown to be of square-cross section, this being typical where they are to be used as wire-wrap terminals. Of course, the concepts of the invention are consistent with any shape of pin, the number of spring fingers of the internal shell of the bushing being selected as a related design matter.

Various interconnections are thereby made in accordance with circuit requirements among the relatively large number of pins (wire-wrap terminals) of the type of 30 and 30′ which would be used in a practical arrangement.

It should be pointed out that the invention could be considered applicable to other electronic manufacturing arrangements where terminals are connected either to voltage or ground back-planes and interconnected by discrete wiring with or without flow-soldering underneath the lower back-plane to wit: 27 on FIG. 3. FIG. 4 illustrates a variation in the barb arrangement for enhancing the grip of the bushing within the corresponding back-plane bore. In FIG. 4, "louvre-like" barbs 33 are employed in lieu of the type of barbs represented at 14 and 15 in FIG. 1A. These alternative barbs, as illustrated in FIG. 4, might be generally elongated parallel to the axial centerline of the bushing, might be canted with respect to the centerline and could even be somewhat spiraled if desired.

It will now be realized that a very important aspect of the present invention is that the pin gripping apparatus is contained in the same axial length as the other body of the bushing, this making it possible to employ a single size bore in all back-planes.

It is not necessary for the flats of the insertedsquare tail (wire-wrap pin) to squarely rest on the edges of the spring fingers 16, 17, 18, and 19 (see FIG. 1C) for the mechanical and electrical engagement to be satisfactory. In fact, the corners of the square pin can provide point contact at 16, 17, 18, and 19, resulting in greater outward deflection of the spring fingers. In the case of a pin of circular or other cross-section, design considerations would dictate at least three spring fingers. More than the four illustrated could obviously be used.

Additional variations and modifications on the design of the bushing and cooperating hardware will suggest themselves to those skilled in this art once the principles of the invention are understood. Accordingly, it is not intended that the drawings or this description should be considered as limiting the invention, these being intended to be typical and illustrative only.

What is claimed is:

1. A bushing for providing electrical and mechanical contact between an elongated conductive terminal member and a bore in a conductive plate member through which said terminal member passes, comprising:

a generally cylindrical, relatively thin-walled first member of a conductive material having a substantial spring characteristic, said cylindrical first member being open at its opposite ends;

a generally coaxial re-entrant portion integral with one end of said first member, said re-entrant portion extending axially within said first member toward the other end thereof for a distance at least part of the axial length of said first member and having an elbow in axial cross-section at said one end corresponding to the inward bend of said re-entrant portion, said re-entrant portion including a second generally cylindrical portion extending from said elbow within the inside of said first member;

a plurality of spring fingers formed by axially slotting said re-entrant portion through the material thickness, said spring fingers rooting at said elbow and having a rest position radially inward from the inside surface of said first cylindrical member, said spring fingers being capable of resiliently deflecting radially outward against the surfaces of a terminal member axially inserted through said bushing; and means including at least one axially extending open cut extending throughout at least the axial length of said first member, the width of said cut being reduced when said bushing is inserted in said bore, the resilience of said material providing radially outwardly acting force to tend to retain said insert within said bore.

2. Apparatus according to claim 1 in which said axially extending cut also extends axially through at least part of said re-entrant portion of said bushing, said cut being the interface between the ends of a flat piece subsequently formed into the generally cylindrical shape of said bushing.

3. Apparatus according to claim 1 in which said axial slotting forming said spring fingers extends through at least a portion of said elbow.

4. Apparatus according to claim 1 in which said spring fingers terminate inside said first cylindrical member.

5. Apparatus according to claim 1 including at least one barb projecting from the external surface of said first member.

6. A back-plane assembly comprising:

at least one conductive back-plane having a bore therethrough;

a bushing mounted in said bore;

said bushing having a length no greater than the thickness of said back-plane;

said bushing having a generally cylindrical outer shell open at its opposite ends and axially slit to form an open slot, said shell having an outside diameter greater than the diameter of said bore when said bushing is removed from said bore whereby said slot tends to be closed upon insertion of said bushing into said bore to exert a resilient outwardly directed force retaining said bushing in said bore;

said bushing also having a second cylindrical shell generally concentrically located within said outer shell, said second shell being formed by a re-entrant fold of the same sheet of material forming said outer shell into the interior of said outer shell; and means dividing said second shell into a plurality of spring fingers assuming rest positions radially inwardly directed within said second shell such that insertion of a conductive pin through said bushing will resiliently deflect said spring fingers radially outward to maintain a residual mechanical retaining action on said pin.

* * * * *